US008098842B2

(12) United States Patent
Florencio et al.

(10) Patent No.: US 8,098,842 B2
(45) Date of Patent: Jan. 17, 2012

(54) ENHANCED BEAMFORMING FOR ARRAYS OF DIRECTIONAL MICROPHONES

(75) Inventors: Dinei Florencio, Redmond, WA (US); Cha Zhang, Bellevue, WA (US); Demba Ba, Cambridge, MA (US)

(73) Assignee: Microsoft Corp., Redmond, WA (US)

( * ) Notice: Subject to any disclaimer, the term of this patent is extended or adjusted under 35 U.S.C. 154(b) by 1138 days.

(21) Appl. No.: 11/692,920

(22) Filed: Mar. 29, 2007

(65) Prior Publication Data

US 2008/0240463 A1 Oct. 2, 2008

(51) Int. Cl.
*H04R 3/00* (2006.01)

(52) U.S. Cl. ..... 381/92; 381/122; 367/119; 704/226; 704/233

(58) Field of Classification Search ..... 381/91–92, 381/122, 94.1–94.3, 93, 66; 367/118–119; 704/226, 233

See application file for complete search history.

(56) References Cited

U.S. PATENT DOCUMENTS

| | | | | |
|---|---|---|---|---|
| 5,511,128 | A | 4/1996 | Lindemann | |
| 7,016,839 | B2 | 3/2006 | Dharanipragada et al. | |
| 7,039,200 | B2 * | 5/2006 | Rui et al. | 381/92 |
| 7,158,645 | B2 | 1/2007 | June et al. | |
| 7,206,418 | B2 * | 4/2007 | Yang et al. | 381/92 |
| 2003/0204397 | A1 | 10/2003 | Amiri et al. | |
| 2005/0094795 | A1 | 5/2005 | Rambo | |
| 2005/0195988 | A1 * | 9/2005 | Tashev et al. | 381/92 |
| 2007/0127736 | A1 * | 6/2007 | Christoph | 381/92 |

FOREIGN PATENT DOCUMENTS

WO WO-0203754 A1 1/2002

OTHER PUBLICATIONS

Allred, D. J., Evaluation and comparison of beamforming algorithms for microphone array speech processing, Thesis, Georgia Institute of Technology.

Cox H., R. M. Zeskind, M. M. Owen, Robust adaptive beamforming, IEEE Trans. Acoust. Speech Signal Processing, Oct. 1987, pp. 1365-1376, vol. 35.

Cutler, R., Y. Rui, A. Gupta, J. J. Cadiz, I. Tashev, L. He, A. Colburn, Z. Zhang, Z. Liu, S. Silverberg, Distributed meetings: a meeting capture and broadcasting system, ACM Multimedia, 2002, pp. 503-512.

El-Keyi, A., T. Kirubarajan, and A. B. Gershmann, Robust adaptive beamforming based on the Kalman filter, IEEE Transactions on Signal Processing, Aug. 2005, pp. 3032-3041, vol. 53.

Griffiths, L. J. and C.W. Jim, An alternative approach to linearly constrained adaptive beamforming, IEEE Trans. Antennas Propagat., Jan. 1982, pp. 27-34, vol. 30.

(Continued)

*Primary Examiner* — Devona Faulk
*Assistant Examiner* — Disler Paul
(74) *Attorney, Agent, or Firm* — Lyon & Harr, LLP; Katrina A. Lyon

(57) ABSTRACT

A novel enhanced beamforming technique that improves beamforming operations by incorporating a model for the directional gains of the sensors, such as microphones, and provides means of estimating these gains. The technique forms estimates of the relative magnitude responses of the sensors (e.g., microphones) based on the data received at the array and includes those in the beamforming computations.

20 Claims, 7 Drawing Sheets

OTHER PUBLICATIONS

Harmanci, K., J. Tabrikian and J. Krolik, Relationships between adaptive minimum variance beamforming and optimal source localization, IEEE Transactions in Signal Processing, Jan. 2000, pp. 1-12, vol. 48.

Hoshuyama, O., A. Sugiyama, and A. Hirano, A robust adaptive beamformer for microphone arrays with a blocking matrix using constrained adaptive filters, IEEE Trans. Signal Processing, Oct. 1999, pp. 2677-2684, vol. 47, No. 10.

Malvar H. S., A modulated complex lapped transform and its applications to audio processing, IEEE Int'l Conf. on Acoustics, Speech, and Signal Processing, Mar. 1999, pp. 1421-1424, Phoenix, AZ.

Microsoft eyes future of teleconferencing with roundtable, Microsoft Corporation, http://www.microsoft.com/presspass/features/2006/oct06/10-20officeroundtable.mspx?pf=true.

Rui, Y., and D. Florencio, Time delay estimation in the presence of correlated noise and reverberation, Proc. of IEEE Int'l Conf. on Acoustics, Speech and Signal Processing, May 17-21, 2004, Montreal, Quebec, Canada.

Strobel, N., S. Spors, and R. Rabenstein, Joint audio-video object localization and tracking, IEEE Signal Processing Magazine, Jan. 2001, pp. 22-21, vol. 18, No. 1.

Tashev, I., H. S. Malvar, A new beamformer design algorithm for microphone arrays, Proceedings of Int'l Conf. of Acoustic, Speech and Signal Processing, ICASSP 2005, Mar. 2005, pp. 101-104, vol. 3, Philadelphia, PA.

Thushara, P., D. Abhayapala, Modal analysis and synthesis of broadband nearfield beamforming arrays, Thesis, Australian National University.

Van Veen, B., and K. Buckley, Beamforming: A versatile approach to spatial filtering, IEEE ASSP Magazine, Apr. 1988, pp. 4-24, vol. 5.

Wang, H., and P. Chu, Voice source localization for automatic camera pointing system in videoconferencing, Proc. IEEE Int. Conf. Acoustics, Speech, and Signal Processing (ICASSP), 1997, pp. 187-190, Munich, Germany.

Zhang, C., P. Yin, Y. Rui, R. Cutler and P. Viola, Boosting-based multimodal speaker detection for distributed meetings, MMSP 2006, Oct. 2006, Victoria, BC, Canada.

* cited by examiner

ENHANCED BEAMFORMING FOR ARRAYS OF DIRECTIONAL MICROPHONES

BACKGROUND

Microphone arrays have been widely studied because of their effectiveness in enhancing the quality of the captured audio signal. The use of multiple spatially distributed microphones allows spatial filtering, filtering based on direction, along with conventional temporal filtering, which can better reject interference or noise signals. This results in an overall improvement of the captured sound quality of the target or desired signal.

Beamforming operations are applicable to processing the signals of a number of sensor arrays, including microphone arrays, sonar arrays, directional radio antenna arrays, radar arrays, and so forth. For example, in the case of a microphone array, beamforming involves processing audio signals received at the microphones of the array in such a way as to make the microphone array act as a highly directional microphone. In other words, beamforming provides a "listening beam" which points to, and receives, a particular sound source while attenuating other sounds and noise, including, for example, reflections, reverberations, interference, and sounds or noise coming from other directions or points outside the primary beam. Pointing of such beams is typically referred to as beamsteering. A generic beamformer automatically designs a set of beams (i.e., beamforming) that cover a desired angular space range in order to better capture the target or desired signal.

Various microphone array processing algorithms have been proposed to improve the quality of the target signal. The generalized sidelobe canceller (GSC) architecture has been especially popular. The GSC is an adaptive beamformer that keeps track of the characteristics of interfering signals and then attenuates or cancels these interfering signals using an adaptive interference canceller (AIC). This greatly improves the target signal, the signal one wishes to obtain. However, if the actual direction of arrival (DOA) of the target signal is different from the expected DOA, a considerable portion of the target signal will leak into the adaptive interference canceller, which results in target signal cancellation and hence a degraded target signal. Although the GSC is good at rejecting directional interference signals, its noise suppression capability is not very good if there is isotropic ambient noise.

A minimum variance distortionless response (MVDR) beamformer is another widely studied and used beamforming algorithm. Assuming the direction of arrival (DOA) of the desired signal is known, the MVDR beamformer estimates the desired signal while minimizing the variance of the noise component of the formed estimate. In practice, however, the DOA of the desired signal is not known exactly, which significantly degrades the performance of the MVDR beamformer. Much research has been done into a class of algorithms known as robust MVDR. As a general rule, these algorithms work by extending the region where the source can be located. Nevertheless, even assuming perfect sound source localization (SSL), the fact that the sensors may have distinct, directional responses adds yet another level of uncertainty that the MVDR beamformer is not able to handle well. Commercial arrays solve this by using a linear array of microphones, all pointing at the same direction, and therefore with similar directional gain. Nevertheless, for the circular geometry used in some microphone arrays, especially in the realm of video conferencing, this directionality is accentuated because each microphone has a significantly different direction of arrival in relation to the desired source. Experiments have shown that MVDR and other existing algorithms perform well when omnidirectional microphones are used, but do not provide much enhancement when directional microphones are used.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The present enhanced beamforming technique improves beamforming operations by incorporating a model for the directional gains of the sensors of a sensor array, and provides means for estimating these gains. The technique forms estimates of the relative magnitude responses of the sensors based on the data received at the array and includes those in the beamforming computations.

More specifically, in one embodiment of the present enhanced beamforming technique, sensor signals from a sensor array in the time domain, such as a microphone array, are input. These signals are then converted into the frequency domain. The signals in the frequency domain are used to compute a beamformer output for each frequency bin as a function of the weights for each sensor using a covariance matrix of the combined noise from reflected paths and auxiliary sources. The signals may also be used to compute a sensor array response vector which includes the intrinsic gain of each sensor as well as its directionality and propagation loss from the source to the sensor. The beamformer outputs for each frequency bin are combined to provide an enhanced output signal with an improved signal to noise ratio over what would be obtainable without taking the gain of each sensor and its directionality and propagation loss into account.

One embodiment of the present enhanced beamforming technique employs an enhanced minimum variance distortionless response (eMVDR) beamformer that can be applied to various microphone array configurations, including a circular array of directional microphones.

It is noted that while the foregoing limitations in existing sensor array noise suppression schemes described in the Background section can be resolved by a particular implementation of the present enhanced beamforming technique, this is in no way limited to implementations that just solve any or all of the noted disadvantages. Rather, the present technique has a much wider application as will become evident from the descriptions to follow.

In the following description of embodiments of the present disclosure reference is made to the accompanying drawings which form a part hereof, and in which are shown, by way of illustration, specific embodiments in which the technique may be practiced. It is understood that other embodiments may be utilized and structural changes may be made without departing from the scope of the present disclosure.

DESCRIPTION OF THE DRAWINGS

The specific features, aspects, and advantages of the disclosure will become better understood with regard to the following description, appended claims, and accompanying drawings where:

DETAILED DESCRIPTION

1.0 The Computing Environment

Before providing a description of embodiments of the present enhanced beamforming technique, a brief, general description of a suitable computing environment in which portions thereof may be implemented will be described. The present technique is operational with numerous general purpose or special purpose computing system environments or configurations. Examples of well known computing systems, environments, and/or configurations that may be suitable include, but are not limited to, personal computers, server computers, hand-held or laptop devices (for example, media players, notebook computers, cellular phones, personal data assistants, voice recorders), multiprocessor systems, microprocessor-based systems, set top boxes, programmable consumer electronics, network PCs, minicomputers, mainframe computers, distributed computing environments that include any of the above systems or devices, and the like.

Figure 1:
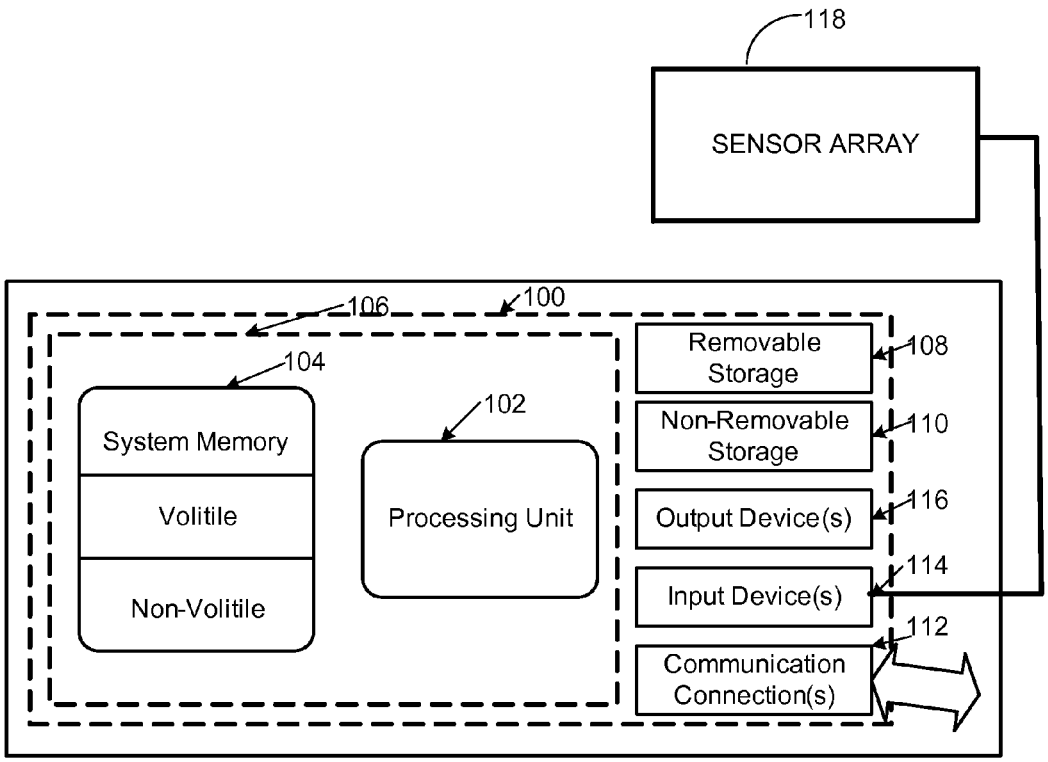
FIG. 1 is a diagram depicting a general purpose computing device constituting an exemplary system for implementing the present enhanced beamforming technique.

FIG. 1 illustrates an example of a suitable computing system environment. The computing system environment is only one example of a suitable computing environment and is not intended to suggest any limitation as to the scope of use or functionality of the present enhanced beamforming technique. Neither should the computing environment be interpreted as having any dependency or requirement relating to any one or combination of components illustrated in the exemplary operating environment. With reference to FIG. 1, an exemplary system for implementing the present enhanced beamforming technique includes a computing device, such as computing device 100. In its most basic configuration, computing device 100 typically includes at least one processing unit 102 and memory 104. Depending on the exact configuration and type of computing device, memory 104 may be volatile (such as RAM), non-volatile (such as ROM, flash memory, etc.) or some combination of the two. This most basic configuration is illustrated in FIG. 1 by dashed line 106. Additionally, device 100 may also have additional features/functionality. For example, device 100 may also include additional storage (removable and/or non-removable) including, but not limited to, magnetic or optical disks or tape. Such additional storage is illustrated in FIG. 1 by removable storage 108 and non-removable storage 110. Computer storage media includes volatile and nonvolatile, removable and non-removable media implemented in any method or technology for storage of information such as computer readable instructions, data structures, program modules or other data. Memory 104, removable storage 108 and non-removable storage 110 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by device 100. Any such computer storage media may be part of device 100.

Device 100 may also contain communications connection(s) 112 that allow the device to communicate with other devices. Communications connection(s) 112 is an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Device 100 has at least one microphone or similar sensor array 118 and may have various other input device(s) 114 such as a keyboard, mouse, pen, camera, touch input device, and so on. Output device(s) 116 such as a display, speakers, a printer, and so on may also be included. All of these devices are well known in the art and need not be discussed at length here.

The present enhanced beamforming technique may be described in the general context of computer-executable instructions, such as program modules, being executed by a computing device. Generally, program modules include routines, programs, objects, components, data structures, and so on, that perform particular tasks or implement particular abstract data types. The present enhanced beamforming technique may also be practiced in distributed computing environments where tasks are performed by remote processing devices that are linked through a communications network. In a distributed computing environment, program modules may be located in both local and remote computer storage media including memory storage devices.

The exemplary operating environment having now been discussed, the remaining parts of this description section will be devoted to a description of the program modules embodying the present enhanced beamforming technique.

2.0 Enhanced Beamforming Technique

The present enhanced beamforming technique improves beamforming operations by incorporating a model for the directional gains of the sensors, such as microphones, and providing means of estimating these gains. One embodiment of the present enhanced beamformer technique employs a Minimum Variance Distortionless Response (MVDR) beamformer and improves its performance.

In the following paragraphs, an exemplary beamforming environment and observational models are discussed. Since one embodiment of the present enhanced beamforming technique employs a MVDR beamformer, additional information on this type of beamformer is also provided. The remaining sections describe an exemplary system and processes employing the present enhanced beamforming technique.

2.1 Exemplary Beamforming Environment

Figure 2:
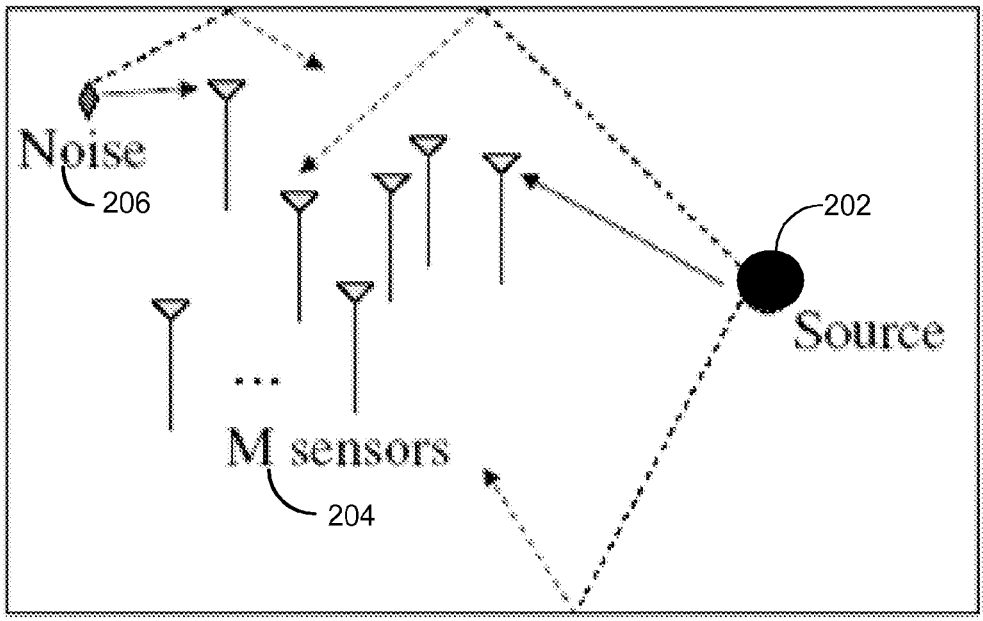
FIG. 2 is a diagram depicting a typical beamforming environment in which a source incident on an array of M sensors in the presence of noise and multi-path is shown.

An exemplary environment wherein beamforming can be performed is shown in FIG. 2. This section explains the general observation model and general beamforming operations in the context of such an environment.

Consider a signal s(t) from the source 202, impinging on the array 204 of M sensors as shown in FIG. 2. The positions of the sensors are assumed to be known. Noise 206 can come from noise sources (such as fans) or from reflections of sound off of the walls of the room in which the sensor array is located.

One can model the received signal $x_i(t), i \in \{1, \ldots, M\}$ at each sensor as:

$$x_i(t)=\alpha_i s(t-\tau_i)+h_i(t) \otimes s(t)+n_i(t). \quad (1)$$

where $\alpha_i$ is a parameter that includes the intrinsic gain of the corresponding sensor as well as its directionality and the propagation loss from the source to the sensor; $\tau_i$ is the time delay of propagation associated with the direct path of the source, which is a function of the source and the sensor's location; $h_i(t)$ models the multipath effects to the source, often referred to as reverberation; $\otimes$ denotes convolution; $n_i(t)$ is the sensor noise at each microphone and s(t) is the original signal. Since beamforming operations are often performed in the frequency domain, one can re-write Equation (1) in the frequency domain as:

$$X_i(\omega)=\alpha_i(\omega)S(\omega)e^{-j\omega\tau_i}+H_i(\omega)S(\omega)+N_i(\omega) \quad (2)$$

where the intrinsic gain of the corresponding sensor, as well as its directionality and propagation loss can vary with frequency. Since multiple sensors are involved, one can express the overall system in vector form:

$$X(\omega)=S(\omega)d(\omega)+H(\omega)S(\omega)+N(\omega) \quad (3)$$

where the received signals at the sensors of the array, $X(\omega)=[X_i(\omega), \ldots X_M(\omega)]^T$;

the array response vector, $d(\omega)=[\alpha_1(\omega)e^{-j\omega\tau_1}, \ldots \alpha_M(\omega)e^{-j\omega\tau_M}]^T$;

the sensor noise, $N(\omega)=[N_i(\omega), \ldots N_M(\omega)]^T$; and the reverberation filter, $H(\omega)=[H_i(\omega), \ldots H_M(\omega)]^T$.

The primary source of uncertainty in the above model is the array response vector $d(\omega)$ and the reverberation filter $H(\omega)$. The same problem appears in sound source localization, and various methods to approximate the reverberation $H(\omega)$ have been proposed. However the effect of $d(\omega)$, and in particular its dependency on the characteristics of the sensors, has been largely ignored in past beamforming algorithms. Although the microphone response may be pre-calibrated, this may not be practical in all cases. For instance, in some of the microphone arrays, the microphones used are directional, which means the gains are different along different directions of arrival. In addition, microphone gain variations are common due to manufacturing tolerances. Measuring the gain of each microphone, at every direction, for each device is time-consuming and expensive.

2.2 Context: Minimum Variance Distortionless Response (MDVR) Beamformer

Since one embodiment improves upon the minimum variance distortionless response (MVDR) beamformer, an explanation of this type of beamformer is helpful.

In general, the goal of beamforming is to estimate the desired signal S as a linear combination of the data collected at the array. In other words, one would like to determine an M×1 set of weights $w(\omega)$ such that the weights times the received signal in the frequency domain ($w^H(\omega)X(\omega)$), is a good estimate of the original signal, $S(\omega)$, in the frequency domain. Note that here the superscript $^H$ denotes the hermitian transpose. The beamformer that results from minimizing the variance of the noise component of $w^H X$, subject to a constraint of gain=1 in the look direction, is known as the MVDR beamformer. The corresponding weight vector w is the solution to the following optimization problem:

$$\min_w w^H Q w \quad \text{subject to the constraint } w^H d = 1 \quad (4)$$

where $$\text{the combined noise, } N_c(\omega)=H(\omega)S(\omega)+N(\omega) \quad (5)$$

$$\text{the covariance matrix of the combined noise, } Q(\omega)=E[N_c(\omega)N_c^H(\omega)] \quad (6)$$

Here $N_c(\omega)$ is the combined noise (reflected paths and auxiliary sources). $Q(\omega)$ is the covariance matrix of the combined noise. The covariance matrix of the combined noise (reflected paths and auxiliary sources) is estimated from the data and therefore inherently contains information about the location of the sources of interference, as well as the effect of the sensors on those sources.

The weight vector w, that gives a good estimate of the desired signal, is a function of the array response vector d and the covariance matrix Q of the combined noise. The optimization problem in Equation (4) has an elegant closed-form solution given by:

$$w = \frac{Q^{-1}d}{d^H Q^{-1} d} \quad (7)$$

where $^H$ denotes the hermitian transpose.

Note that the denominator of Equation (7) is merely a normalization factor which enforces the gain=1 constraint in the look direction.

The above described MVDR beamforming algorithm has been very popular in the literature. In most previous works, the sensors are assumed to be omni-directional or all pointing in the same direction (and assumed to have the same directional gain). Namely, the intrinsic gain of the corresponding sensor, as well as its directionality and propagation loss, $\alpha_i$, in the array response vector, d, are assumed to be equal to 1 (or measurable beforehand). However this may not always be true. For instance, many microphone arrays use highly directional, uncalibrated microphones. Therefore, the intrinsic gains of each sensor, as well as the corresponding directionality and propagation loss, $\alpha_i$, are unknown and have to be estimated from the perceived signal.

2.3 MVDR with Sensor Gain Compensation

In one embodiment of the present enhanced beamforming technique, the technique improves on a MVDR beamformer by employing the MDVR beamformer with an estimate of relative microphone gains. More particularly, the present enhanced beamformer technique assigns a weight $g_i$, $i \in 1, \ldots M$, to each of the components of the array response vector, d, based on the relative strength of the signal recorded at sensor i compared to all the other sensors. The technique can then compensate for the effect of sensors with directional gain patterns. The following section describes how the weights based on the relative gain of each sensor $g_i$, are computed based on the data received at the array.

Theoretically, this can be described as follows. Assume that the desired signal $S(\omega)$ and noise $N_i(\omega)$ are uncorrelated. The energy in the reflected paths of the signal (the second term in Equation (2)) is very complex.

If it is assumed that energy in the reflected path of the signal is a proportion $\gamma$ of the received signal minus the noise, $|X_i(\omega)|^2-|N_i(\omega)|^2$, then, the energy in the reflected path of the signal can be defined as:

$$E[|X_i(\omega)|^2]=|\alpha_i(\omega)|^2|S(\omega)|^2+\gamma|X_i(\omega)|^2+(1-\gamma)|N_i(\omega)|^2$$

Rearranging the above equation, one obtains $$|\alpha_i(\omega)||S(\omega)|=\sqrt{(1-\gamma)(|X_i(\omega)|^2-|N_i(\omega)|^2)} \quad (8)$$

In Equation (8), $|X_i(\omega)|^2$ can be directly computed from the data collected at the array. The noise, $|N_i(\omega)|^2$, can be determined from the silence periods of $X_i(\omega)$. Note that $|\alpha_i(\omega)|$ on its own cannot be estimated from the data; only the product $|\alpha_i(\omega)||S(\omega)|$ is observable from the data. However, this is not an issue because only the relative gain of a given sensor with respect to other sensors is desired. Therefore, one can define the weight defining the gain of each microphone $g_i$, as follows:

$$g_{i,} = -\frac{|\alpha_i(\omega)||S(\omega)|}{\sum_{j=1,\ldots M} |\alpha_i(\omega)||S(\omega)|}, i \in 1, \ldots M \tag{9}$$

The resulting array response vector d is given by $$d(\omega)=[g_1(\omega)e^{-j\omega\tau_1}, \ldots g_M(\omega)e^{-j\omega\tau_M}] \tag{10}$$

The corresponding weight vector w is obtained by substituting Equation (10) in the closed-form solution to the MVDR beamforming problem (Equation (7)). Note that $g_i$, as defined in Equation (9) compensates for the gain response of the sensors.

2.4 Exemplary Architecture of the Present Enhanced Beamforming Technique.

Figure 3:
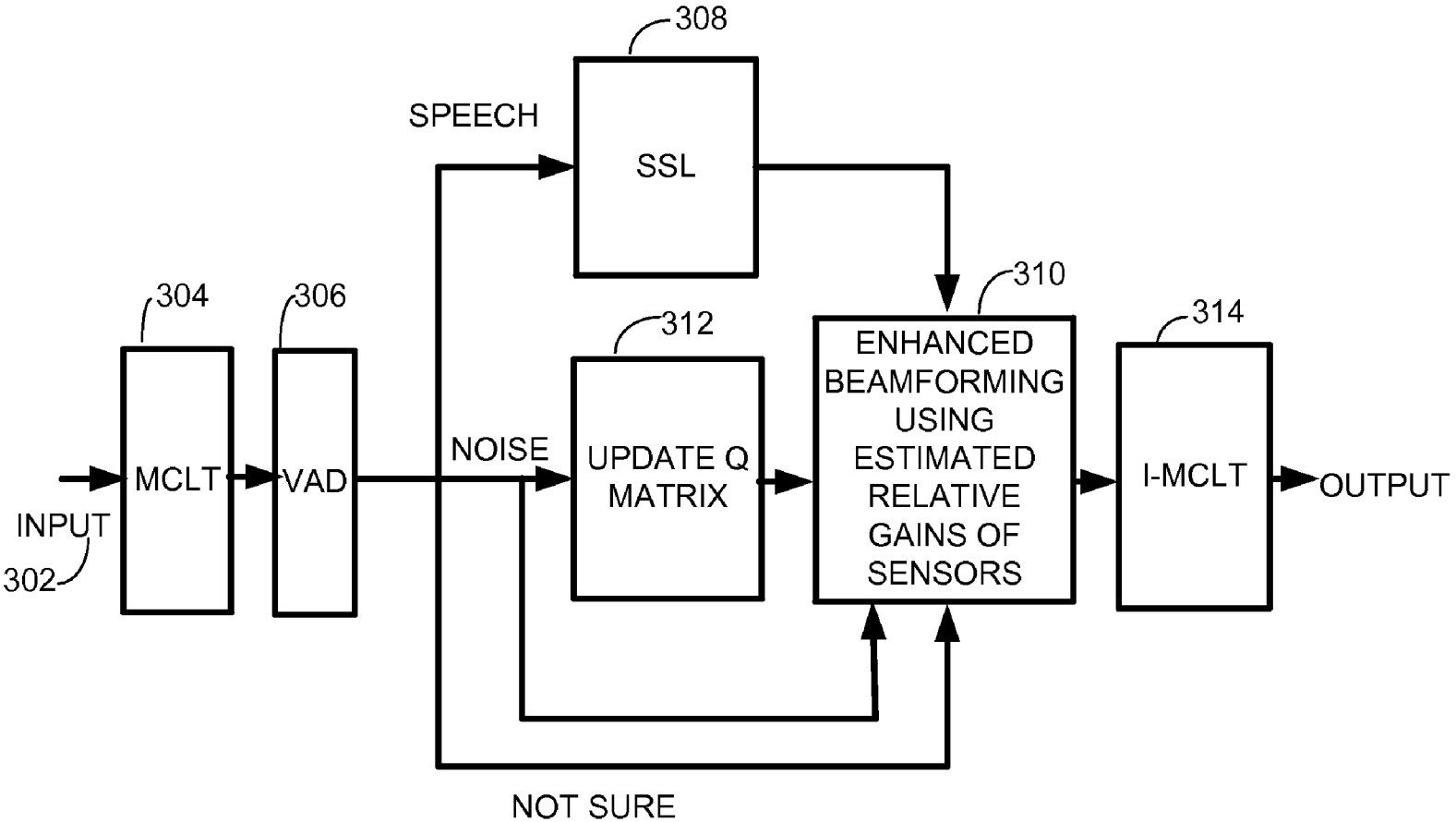
FIG. 3 is a diagram depicting one exemplary architecture of the present enhanced beamforming technique.

FIG. 3 provides the architecture of one exemplary embodiment of the present beamforming technique. As shown in FIG. 3, the signals 302 received at the sensor array (e.g., microphone array) are input into a converter 304 that converts the time domain signals into frequency domain signals. In one embodiment this is done by using a Modulated Complex Lapped Transform (MCLT), but it could equally well be done by using a Fast Fourier Transform, a Fourier filter bank, or using other conventional transforms designed for this purpose. The signals in the frequency domain, divided into frames, are then input into a Voice Activity Detector (VAD) 306, that classifies each input frame as one of three classes: Speech, Noise, or Not Sure. If the VAD 306 classifies the frame as Speech, sound source localization (SSL) takes place in a SSL module 308 in order to obtain a better estimate of the location of the desired signal which is used in computing the time delay of propagation. The SSL algorithm used in one embodiment of the present enhanced beamforming technique is based on time delay of arrival of the signal and maximum likelihood estimation. The sound source location and received speech frame are then input into a beamforming module 310 which finds the best output signal to noise ratio using the relative gains of the sensors in the form of an array response vector and a weight vector for the sensors. If the VAD 306 classifies the input signal as Noise the signal is used to update the noise covariance matrix, Q, in the covariance update module 312, which provides a better estimate of which part of the signal is noise. The noise covariance matrix Q is computed from the frames classified as Noise by computing the sample mean. Several methods can be used for that purpose. One can simply average the cross product between the transform coefficient of each microphone for a given frequency (note that a Q matrix is computed for each frequency). Additionally, many other methods can be used to estimate the noise covariance matrix, e.g., by employing an exponential decay. These methods are well known to those with ordinary skill in the art. Beamforming is also performed in module 310 using the frames classified as Not Sure or as Noise, using the weights of the speech frame that was last encountered. Once the total beamforming output is computed it can be converted back into the time domain using an inverse converter 314 to output an enhanced signal in the time domain 316. The enhanced output signal can then be manipulated in other ways, such as by encoding it and transmitting it, either encoded or not.

Figure 4:
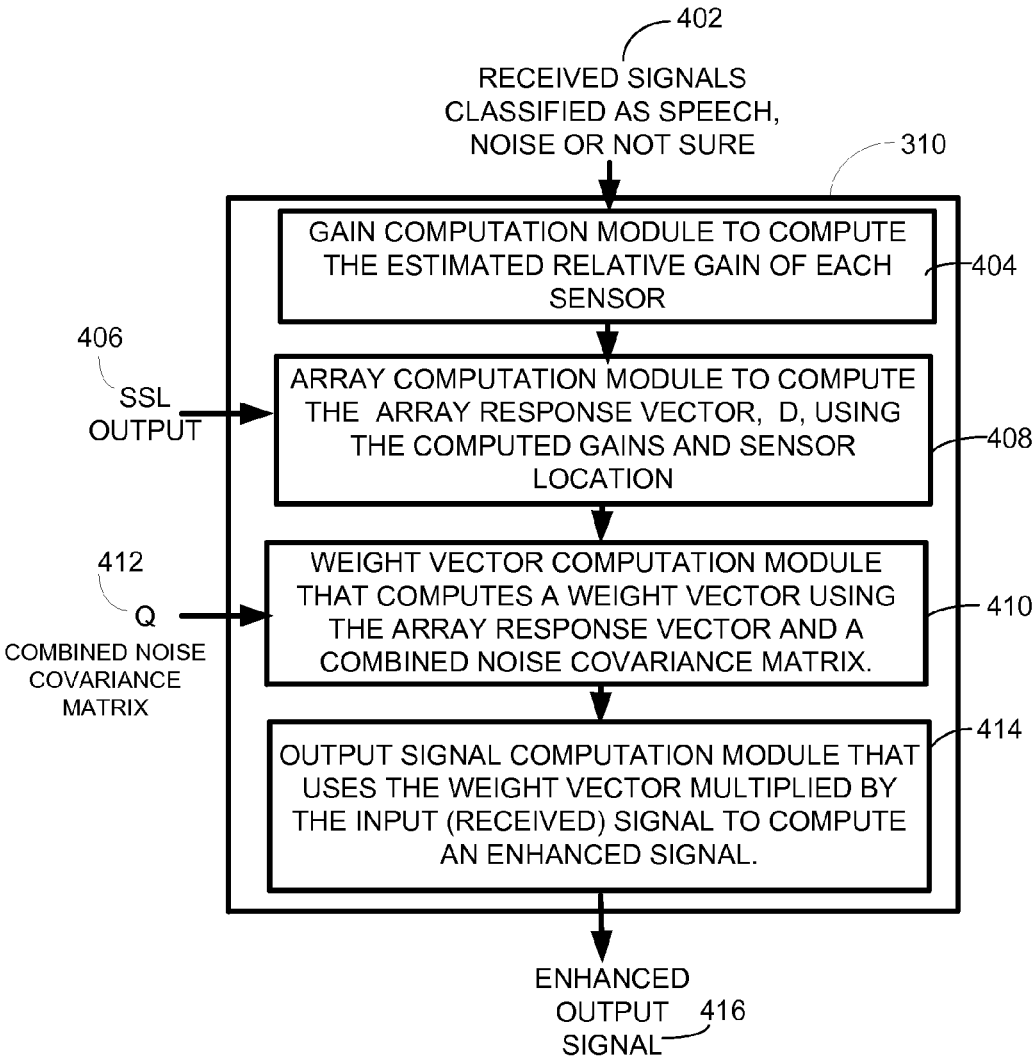
FIG. 4 is a diagram depicting the beamforming module of the exemplary architecture of the present enhanced beamforming technique shown in FIG. 3.

FIG. 4 provides a more detailed schematic of the beamforming module 310 of FIG. 3. The signals classified as Speech, Noise or Not Sure 402 are input into the beamforming module 310. A gain computation module 404 computes the relative gain of each sensor. In one embodiment of the present enhanced beamforming technique this is done using Equation (9) described above. The relative gains and the sound source location 406 are then used to compute the array response vector, d, in an array computation module 408. The weight vector computation module 410 then uses the covariance matrix of the combined noise, Q, 412 and the computed array response vector, d, to compute the weight vector, w. Finally, the output signal computation module 414 computes an enhanced output signal 416 by multiplying the weight vector by the received (input) signal.

2.5 Exemplary Processes of the Enhanced Beamforming Technique.

Figure 5:
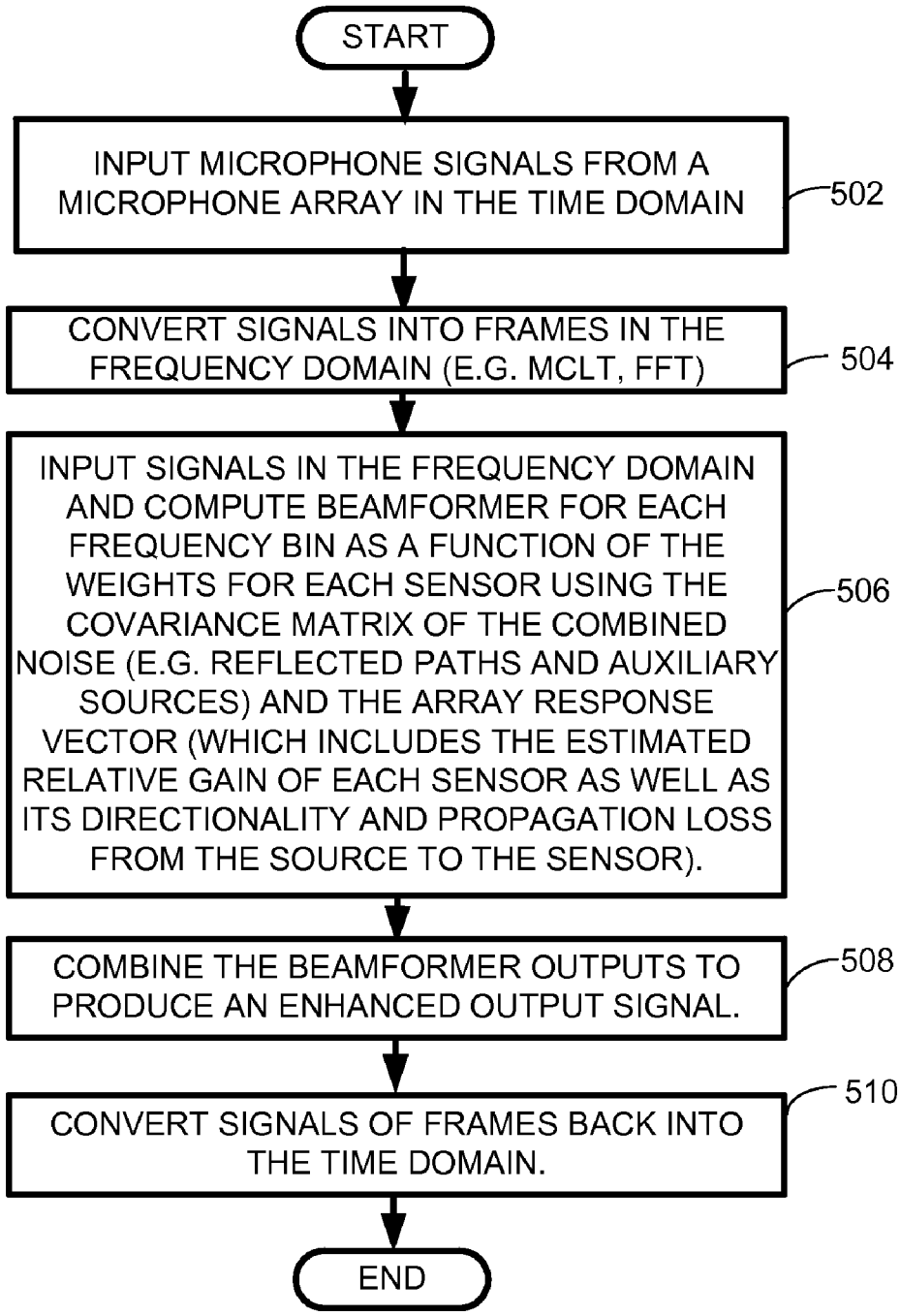
FIG. 5 is a flow diagram depicting one generalized exemplary embodiment of a process employing the present enhanced beamforming technique.

FIG. 5 depicts a general exemplary process of the present enhanced beamforming technique. In one embodiment each received frame first undergoes a transformation to the frequency domain using the modulated complex lapped transform (MCLT) (boxes 502, 504) The MCLT has been shown to be useful in a variety of audio processing applications. Alternatively, other transforms, such as, for example, the discrete Fourier transform could be used. The signals in the frequency domain are used to compute a beamformer for each frequency bin as a function of the weights for each sensor using the covariance matrix of the combined noise (e.g., reflected paths and auxiliary sources) and the array response vector, which includes the intrinsic gain of each sensor as well as its directionality and propagation loss from the source to the sensor (box 506). The beamformer outputs of each frequency bin are combined to produce an enhanced output signal with an improved signal to noise ratio (box 508). After beamforming, the time domain estimate of the desired signal can then be computed from its frequency domain estimate through inverse MCLT transformation (IMCLT) or other appropriate inverse transform (box 510).

Figure 6:
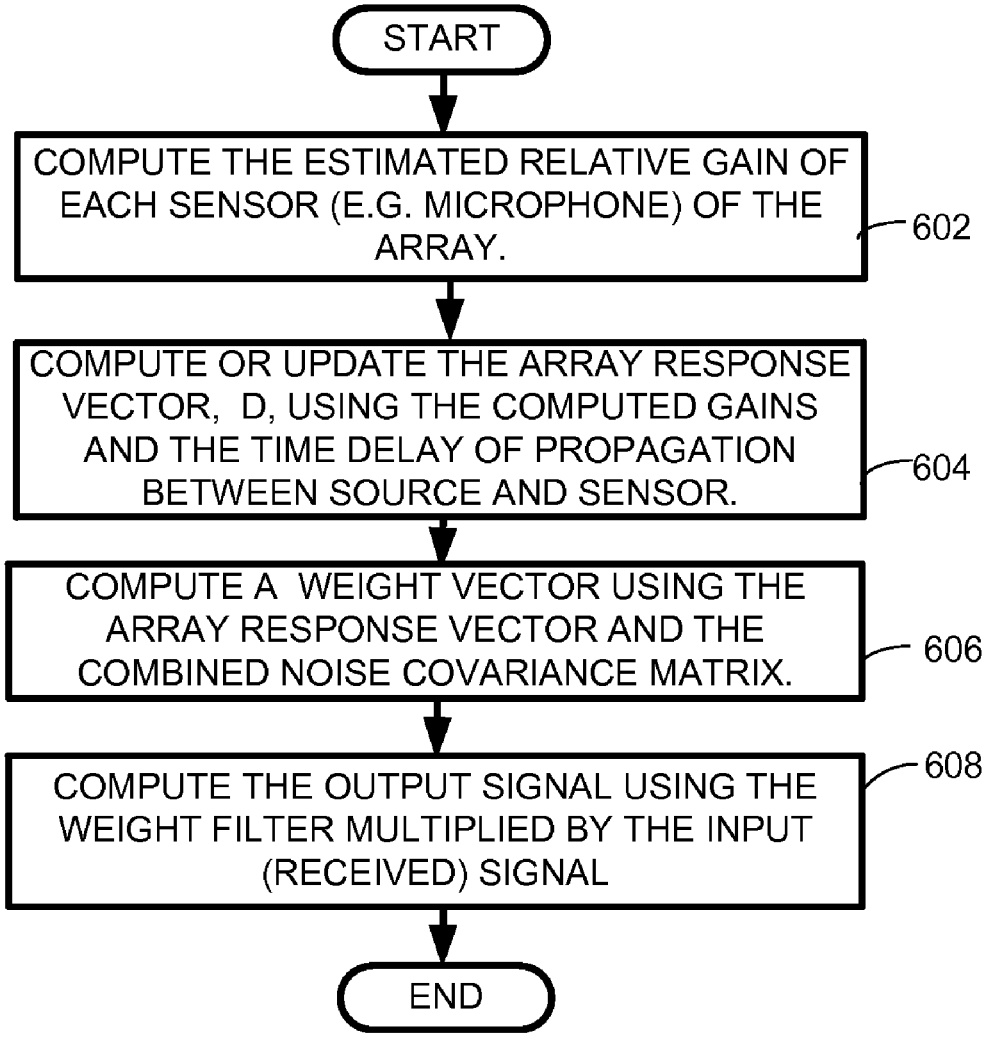
FIG. 6 is a flow diagram depicting the beamforming operations shown in the present enhanced beamforming technique.

FIG. 6 provides a more detailed description of box 506, where the beamforming operations take place. As shown in FIG. 6, box 602, an estimate of the relative gain of each sensor, such as a microphone, of the array are computed. The array response vector, d, is then computed using the computed gains and the time delay of propagation between the source and the sensor (box 604). Once the array response vector is available, it is used, along with the combined noise covariance matrix, Q, to obtain the weight vector (box 606). Finally, the enhanced output signal can be computed by multiplying the weight vector, w, by the received signal (box 608).

Figure 7:
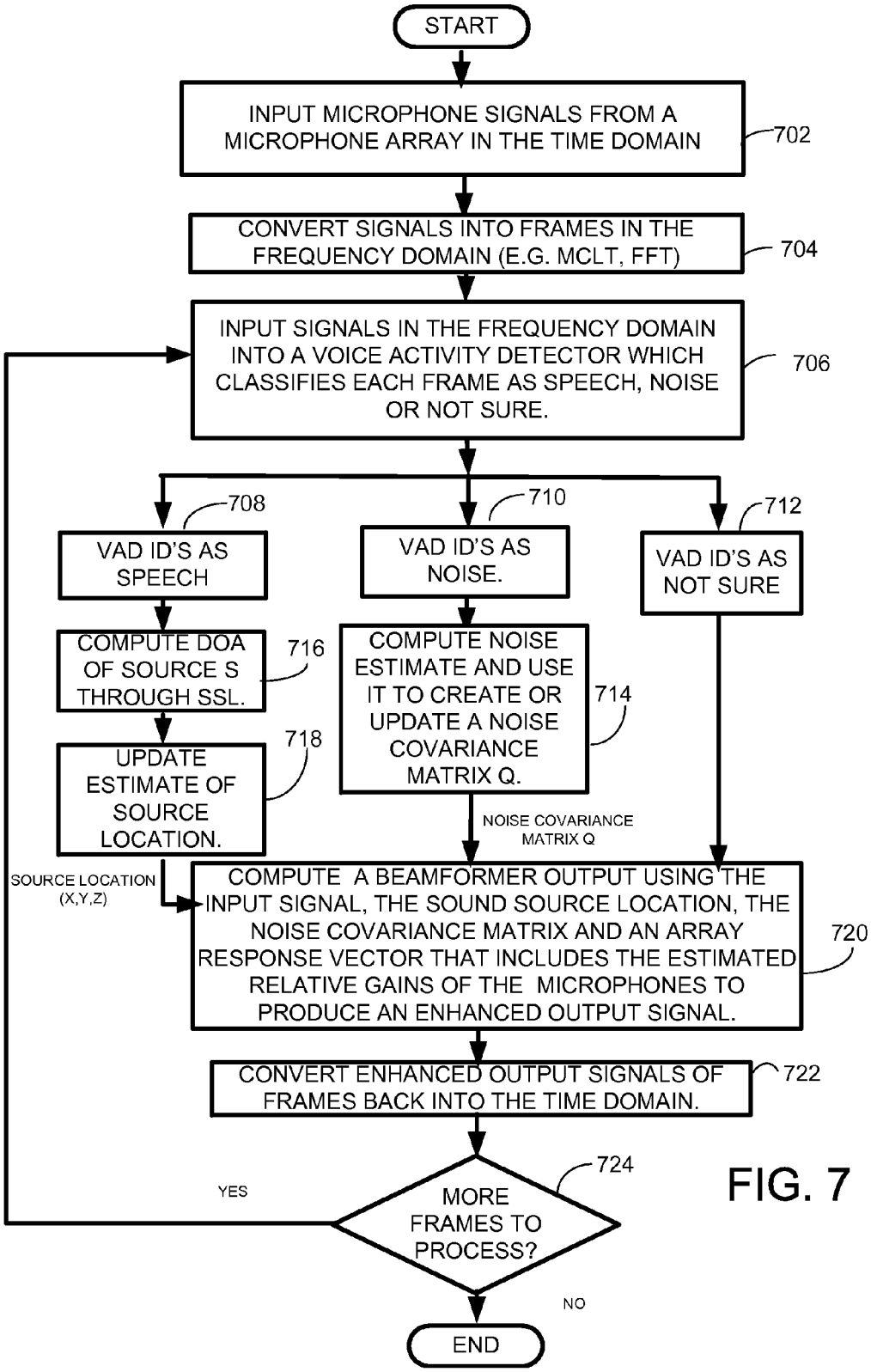
FIG. 7 is a flow diagram depicting another exemplary embodiment of a process employing the present enhanced beamforming technique.

FIG. 7 depicts a more detailed exemplary process of one embodiment of the present enhanced beamforming technique. As shown in block 702, the received signals in the time domain of a microphone array are input. Each frame undergoes a transformation to the frequency domain (box 704). In one embodiment this transformation from the time domain to the frequency domain is made using a modulated complex lapped transform (MCLT). Alternatively, the discrete Fourier transform, or other similar transforms could be used. Once in the frequency domain, each frame goes through a voice activity detector (VAD) (box 706). The VAD classifies a given frame as one of three possible choices, namely Speech 708, Noise 710, or Not Sure 712. The noise covariance matrix Q is computed from frames classified as Noise (box 714). The DOA and location of the source S is determined from frames classified as Speech through SSL (box 716, 718). This is followed by beamforming in the manner shown in FIG. 6 (box 720). In one embodiment a MVDR beamformer is used. The process is repeated for all frequency bins to create an output signal with an enhanced signal to noise ratio. After beamforming, the time domain estimate of the desired signal may be computed from its frequency domain estimate through inverse MCLT transformation or other appropriate inverse transform (IMCLT) (box 722). The process is repeated for next frames, if any (box 724).

It should also be noted that any or all of the aforementioned alternate embodiments may be used in any combination desired to form additional hybrid embodiments. For example, even though this disclosure describes the present enhanced beamforming technique with respect to a microphone array, the present technique is equally applicable to sonar arrays, directional radio antenna arrays, radar arrays, and the like. Although the subject matter has been described in language specific to structural features and/or methodological acts, it is to be understood that the subject matter defined in the appended claims is not necessarily limited to the specific features or acts described above. The specific features and acts described above are disclosed as example forms of implementing the claims.

Wherefore, what is claimed is:

1. A computer-implemented process for improving the signal to noise ratio of one or more signals from sensors of a sensor array, comprising:

inputting signals of sensors of a sensor array in the frequency domain defined by frequency bins;

for each frequency bin, computing a beamformer output as a function of weights for each sensor, wherein the weights are computed using combined noise from reflected paths and auxiliary sources, and a sensor array response which includes the intrinsic gain of each sensor as well as its directional propagation loss from the source to the sensor;

combining the beamformer outputs for each frequency bin to produce an output signal with an increased signal to noise ratio over what would be obtainable directional gain of each sensor and its directional propagation loss into account.

2. The computer-implemented process of claim 1 wherein the input signals of the sensor array in the frequency domain are converted from the time domain into the frequency domain prior to inputting them using a Modulated Complex Lapped Transform (MCLT).

3. The computer-implemented process of claim 1 wherein the sensors are microphones and wherein the sensor array is a microphone array.

4. The computer-implemented process of claim 1 wherein the sensors are one of:

sonar receivers and wherein the sensor array is a sonar array;

directional radio antennas and the sensor array is a directional radio antenna array; and radars and wherein the sensor array is a radar array.

5. The computer-implemented process of claim 1 wherein computing a beamformer comprises employing a minimum variance distortionless response beamformer.

6. The computer-implemented process of claim 1 wherein computing the beamformer output comprises:

computing an estimate of the relative gain of each sensor;

computing an array response vector, using the computed relative gains of each sensor and the time delay of propagation between the source and each sensor;

using the array response vector and a combined noise covariance matrix representing noise from reflected paths and auxiliary sources to obtain a weight vector; and computing an enhanced output signal by multiplying the weight vector by the input signals.

7. The computer-implemented process of claim 6 wherein the signal time delay of propagation is computed using a sound source localization procedure.

8. The computer-implemented process of claim 6 wherein the combined noise matrix is obtained by using a voice activity detector.

9. A computer-implemented process for improving the signal to noise ratio of one or more signals from sensors of a sensor array, comprising:

inputting signal frames from microphones of a microphone array in the frequency domain;

inputting each frame in the frequency domain into a voice activity detector which classifies the frame as speech, noise or not sure;

if the voice activity detector identifies the frame as speech, computing the direction of arrival of the source signal using sound source localization and using the direction of arrival to update an estimate of the source location;

if the voice activity detector identifies the frame as noise, computing a noise estimate and using it to update a combined noise covariance matrix representing reflected sound and sound from auxiliary sources;

computing a beamformer output using the frames classified as Speech, Not Sure or as Noise, the sound source location, the noise covariance matrix, and an array response vector which includes the relative gains of the sensors, to produce an output signal with an enhanced signal to noise ratio.

10. The computer-implemented process of claim 9 wherein computing the beamformer output comprises:

computing an estimate of the relative gain of each sensor;

computing an array response vector, using the computed relative gains and the time delay of propagation between the source and each sensor;

using the array response vector and a combined noise covariance matrix representing noise from reflected paths and auxiliary sources to obtain a weight vector; and computing an enhanced output signal by multiplying the weight vector by the input signals.

11. The computer-implemented process of claim 9 further comprising converting the output signal from the frequency domain to the time domain.

12. The computer-implemented process of claim 9 wherein the voice activity detector evaluates all frequency bins of the frame in identifying the frame as speech.

13. A system for improving the signal to noise ratio of a signal received from a microphone array, comprising:

a general purpose computing device;

a computer program comprising program modules executable by the general purpose computing device, wherein the computing device is directed by the program modules of the computer program to, capture audio signals in the time domain with a microphone array;

convert the time-domain signals to the frequency-domain using a converter;

input the frequency domain signals divided into frames into a Voice Activity Detector (VAD), that classifies each signal frame as either Speech, Noise, or Not Sure;

if the VAD classifies the frame as Speech, perform sound source localization in order to obtain a better estimate of the location of the sound source which is used in computing the time delay of propagation;

if the VAD classifies the frame as Noise the signal is used to update a noise covariance matrix, which provides a better estimate of which part of the signal is noise; and perform beamforming using the frames classified as Speech, Not Sure or as Noise, the noise covariance matrix, the sound source location, and an array response vector which includes an estimate of the relative gains of the sensors, to produce an enhanced output signal in the frequency domain.

14. The system of claim 13 wherein the VAD uses more than one frequency bin of the frame to classify the input signal as noise.

15. The system of claim 14 wherein the noise covariance matrix is computed from frames classified as noise by computing their sample mean.

16. The system of claim 13 further comprising at least one module to:

encode the enhanced beamformer output;

transmit the encoded enhanced beamformer output; and transmit the enhanced beamformer output.

17. The system of claim 13 wherein the beamforming module comprises sub-modules to:

compute an estimate of the relative gain of each sensor;

use the sound source location and the estimated relative gains to compute the array response vector;

use the noise covariance matrix and the computed array response vector, to compute a weight vector; and compute the enhanced output signal by multiplying the weight vector by the input signal.

18. The system of claim 13 wherein the beamformer output is computed using a minimum variance distortionless response beamformer.

19. The system of claim 13 wherein the microphones of the microphone array are arranged in a circular configuration.

20. The system of claim 13 wherein the microphones of the array are directional.

* * * * *